US006203624B1

(12) United States Patent
Bargues et al.

(10) Patent No.: US 6,203,624 B1
(45) Date of Patent: Mar. 20, 2001

(54) ORGANOMINERAL DECONTAMINATION GEL AND USE THEREOF FOR SURFACE DECONTAMINATION

(75) Inventors: Stéphane Bargues, Gif-sur-Yvette; Frédéric Favier; Jean-Louis Pascal, both of Montpellier; Jean-Pierre Lecourt, Les Ulis; Frédérique Damerval, Verrieres-le-Buisson, all of (FR)

(73) Assignee: STMI - Societe des Techniques en Milieu Ionisant, Gif-sur-Yvette (FR)

( * ) Notice: Subject to any disclaimer, the term of this patent is extended or adjusted under 35 U.S.C. 154(b) by 0 days.

(21) Appl. No.: 09/142,165

(22) PCT Filed: Mar. 20, 1997

(86) PCT No.: PCT/FR97/00491

§ 371 Date: Nov. 24, 1998

§ 102(e) Date: Nov. 24, 1998

(87) PCT Pub. No.: WO97/35323

PCT Pub. Date: Sep. 25, 1997

(30) Foreign Application Priority Data

Mar. 21, 1996 (FR) ..... 96 03517

(51) Int. Cl.[7] ..... C23G 1/02; A62D 3/00; C11D 3/075

(52) U.S. Cl. ..... 134/3; 134/2; 510/110; 516/99; 516/109; 516/903; 588/236; 588/901

(58) Field of Search ..... 516/99, 109, 903; 510/110; 588/236, 901; 134/2, 3

(56) References Cited

U.S. PATENT DOCUMENTS

| | | | | |
|---|---|---|---|---|
| 3,080,262 | * | 3/1963 | Newman | 134/3 |
| 3,699,048 | * | 10/1972 | Krueger et al. | 134/2 X |
| 4,880,559 | * | 11/1989 | Murray et al. | 510/110 |
| 5,509,969 | * | 4/1996 | Grawe | 134/2 |

FOREIGN PATENT DOCUMENTS

| | | | | |
|---|---|---|---|---|
| 0589781 | * | 3/1994 | (EP) . | |
| 0674323 | * | 9/1995 | (EP) . | |
| 2656949 | * | 7/1991 | (FR) . | |
| 000826872 | * | 1/1993 | (RU) | 588/901 |

* cited by examiner

*Primary Examiner*—Richard D. Lovering
(74) *Attorney, Agent, or Firm*—Oblon, Spivak, McClelland, Maier & Neustadt, P.C.

(57) ABSTRACT

An organomineral decontamination gel that is used to decontaminate surfaces, in particular metal surfaces. The organomineral gel is made up of a colloid solution containing the combination of a mineral viscosing agent and an organic viscosing agent (coviscosant) chosen from among hydrosoluble organic polymers and surfactants. The presence of an organic viscosing agent improves the rheological properties of gels and substantially reduces their mineral content which generates smaller quantities of solid waste. A decontamination process for metal surface which entails applying the organomineral gel onto the surface to be decontaminated, maintaining this gel on the surface and removing the gel from the surface in particular by rinsing is also provided.

36 Claims, 1 Drawing Sheet

(Pa.sec)
0,8
0,6
0,4
0,2
0
t (sec)
0
2
4
6
60

(Pa.sec)
25
20
15
10
5
t(sec)
0
2
4
6
60

ORGANOMINERAL DECONTAMINATION GEL AND USE THEREOF FOR SURFACE DECONTAMINATION

This application is a §371 application of PCT/FR 97/00491 filed on Mar. 20, 1997.

BACKGROUND OF THE INVENTION

1. Field of the Invention

The present invention relates to an organomineral decontamination gel that can be used for radioactive decontamination of surfaces, in particular metal surfaces.

2. Description of the Background

The decontamination of parts soiled by radioactive elements can be conducted either by mechanical treatment or by chemical treatment.

The methods which use mechanical treatment have the disadvantage of producing a more or less substantial change in the surface of the part, and also of being difficult to implement on parts of complicated shape.

Soaking treatment methods which consist essentially of removing the radioactive elements fixed on the surface of the part with solutions of appropriate active decontaminant agents, in particular Ce(IV) stabilized in a concentrated strong acid medium such as nitric or sulphuric acid, have the disadvantage of leading to the production of considerable volumes of effluent whose subsequent treatment, by concentration in particular, is very costly.

Also, soaking methods using solutions raise some problems for the treatment of large-size parts that are difficult to immerse and to soak entirely in the solution of reagents.

With decontamination solutions, treatment by soaking can only be applied to metal parts of restricted size which can be dismounted, that is to say that these solutions can only be used in practice when radioactive installations are being dismantled.

Also, the on-site decontamination of radioactive installations by spraying aqueous solutions produces large quantities of radioactive effluent and only has limited efficacy on account of the short contact time with the parts.

The idea was therefore put forward to viscose decontamination solutions comprising an active agent with viscosing/gelling agents, in particular with divided solids having a large specific surface area, elementary particles of small size and chemically inert.

Among the solids meeting these requirements, mineral base materials such as aluminas and silicas available on the market, which also offer a large diversity in characteristics such as hydrophilic, hydrophobic properties, pH . . . appear to be the best means for viscosing/gelling these solutions.

Spraying such gels, unlike solutions, can make possible the on-site decontamination of large-size metal surfaces which are not necessarily horizontal but which may also be inclined or even vertical.

Decontamination gels may, therefore, be described as colloid solutions comprising a viscosing agent that is generally mineral such as alumina or silica, and a decontamination agent, for example an acid, a base, an oxidizing agent, a reducing agent or a mixture of the latter, chosen in particular in relation to the type of surface contamination.

Hence an alkaline gel for stainless and ferrite steels will offer degreasing properties for the removal of non-fixed contamination.

An oxidizing gel for stainless steels for the removal of heat or cold fixed contamination. A reducing gel will preferably be used in addition to and alternate with the oxidizing gel to dissolve heat-formed oxides for example in the primary circuit of pressurized water reactors (PWR).

Finally, an acid gel for ferrite steels will remove cold fixed contamination.

The use of gels for the radioactive decontamination of parts is described in particular in document FR-A-2 380 624.

In this document, a decontaminant gel is used that is made up of a colloid solution of an organic or mineral compound to which may be added a decontaminant product such as hydrochloric acid, stannous chloride, sodium oxine and/or fluoride.

Although these gels give satisfactory results, they nevertheless have the disadvantage of only being able to remove encrusted radioactivity to a short depth of the part's surface, for example to a depth of approximately 1 $\mu$m.

Document FR-A-2 656 949 describes an oxidizing decontaminant gel which can be used to remove radioactive elements deposited on the part as well as radioactive elements encrusted on its surface.

This decontaminant gel is made up of a colloid solution comprising:

a) 8 to 25% by weight of a mineral gelling agent, preferably silica-based, preferably pyrogenous silica or alumina, b) 3 to 10 mol/l of an oxidizing agent such as $Ce^{IV}$, $Co^{III}$ or $Ag^{II}$ having a standard electrode potential $E_0$ of more than 1400 mV/SHE (standard hydrogen electrode) in a strong acid medium (pH<1) or the reduced form of this oxidizing agent.

In the latter case, the gel also comprises 0.1 to 1 mol/l of a compound d) able to oxidize the reduced form of this oxidizing agent.

In the above-described decontaminant gel, the presence of constituents b) and c) respectively ensures the removal of radioactive deposits formed on the surface of the part and the removal of encrusted radioactivity, through controlled erosion of the surface to be decontaminated.

This oxidizing gel does not, however, have sufficient efficacy vis-a-vis the adherent metal oxide layers deposited on the surface of alloys such as autenite steels, Inconel 600 and Incoloy.

Document FR-A-2 695 839 therefore describes a reducing decontaminant gel which can be used to remove these layers of adherent metal oxide, which comprises :

a) 20 to 30% by weight of a mineral gelling agent, preferably alumina-based, b) 0.1 to 14 mol/l of a mineral base, such as NaOH or KOH, and c) 0.1 to 4.5 mol/l of a reducing agent having a standard electrode potential $E_0$ of less than −600 mV/SHE in a strong base medium (pH=13) chosen from among borohydrides, sulphites, hydrosulphites, sulphides, hypophosphites, zinc and hydrazine.

The application of the gels to the surface, for example the metal surface, to be decontaminated is preferably made by gun spraying, for example under a pressure that may range from 50 to 160 bars and even higher, the gel being shaken before spraying to homogenize the gel. After adequate action time, the gel is rinsed by spraying water, and the effluent generated is treated for example by neutralization, decantation and filtration.

All the gels described above, whether alkaline, acid, reducing or oxidizing, in addition to the advantages already described above such as the possible treatment of parts of complex shape, also have the advantages of easy implementation, low quantity of chemical reagents sprayed per surface unit, therefore a small quantity of effluent produced when rinsing the applied gels, full control over surface contact time and therefore control over erosion during decontamination. In addition, since it is possible to spray the gel from a distance, the doses absorbed by staff in charge of carrying out radioactive cleaning are greatly reduced.

Typical gels of the prior art are marketed by FEVDI under the trade name "FEVDIRAD ".

All the above gels, whether acid, alkaline, oxidizing or reducing also offer good corrosive properties, especially the oxidizing gels,.

Unfortunately, they cannot tolerate high shear speeds needed for spraying, which is the most conventional process for applying these gels.

All these gels comprising a mineral viscosing agent, silica in particular, whether hydrophilic, hydrophobic, basic or acid, have Theological properties that are characteristically thixotropic: their viscosity decreases under shear forces during spraying, followed by restructuration of the gel and surface adhesion when shearing stops. A rheogram showing hysteresis characterizes the response of this type of fluid.

Control over such thixotropy is of fundamental importance to obtain optimal spraying and adhesion of the gel to the surface to be treated. The quick re-setting time of the gels, or their full or partial restructuring, constitutes the essential concept of their spraying.

Restructuration denotes a return to gel state and therefore adhesion to the surface, and a short re-setting time characterizes a gel which swiftly recovers sufficient viscosity after spraying to prevent any dripping.

Regardless of the mineral viscosing agent content of the above-described gels or those currently marketed, re-setting times are too long. For example, for various content levels of Cab-O-Sil M5, which is an acid, hydrophilic pyrogenous silica marketed by DEGUSSA, the re-setting times are always longer than 5 seconds, which is far too excessive.

Return time to sufficient viscosity so that the gel can adhere to the wall may be reduced, it is true, but this requires a substantial increase in the mineral conten.

Viscosity under shaking before spraying is high in this case, and spraying becomes difficult. Also, this higher mineral load generates substantial quantities of effluent on rinsing and solid waste to be treated.

For example, 20 kg of gel, after treatment by filtration of the rinse effluent, currently produce a volume of radioactive waste equivalent to a 200 1 drum.

A need therefore exists to improve the Theological properties of existing gels whose gelling/viscosing agent is solely silica or alumina-based, in particular in order to obtain shorter re-setting times, and therefore to increase gel restructuring capacity while maintaining systems which, when shaken, are sufficiently liquid to allow spraying.

SUMMARY OF THE INVENTION

These improvements may be obtained with a lower mineral content, preferably much lower than the mineral content of gels of the prior art, in order to generate minimal volumes of solid waste.

Finally, these improvements in Theological properties must be obtained without affecting the corrosive and other qualities of these decontamination gels.

In particular, the decontamination factors obtained must be at least identical to those of existing gels.

The purpose of the present invention is therefore to provide a decontamination gel which, among other things, meets all the above-mentioned needs Through this invention, this and other purposes are achieved with an organomineral decontamination gel made up of a colloid solution comprising:

a) a viscosing agent b) an active decontamination agent characterized in that viscosing agent a) comprises the combination of a mineral viscosing agent with an organic viscosing agent (coviscosant) chosen from among hydrosoluble organic polymers and surfactants.

DETAILED DESCRIPTION OF THE PREFERRED EMBODIMENTS

According to the invention, incorporating into viscosing agent a) of the decontamination gel an organic viscosing agent (called coviscosant) in addition to the mineral viscosing agent, surprisingly produces a strong improvement in the Theological properties of the gels and enables the mineral content of these gels to be substantially reduced without affecting the corrosive and other qualities of these gels.

The decrease in the mineral content leads to a concomitant decrease in solid waste.

The decontamination factors obtained with the gels of the invention are fully comparable with, and even superior to, those of similar gels of the prior art, that is to say gels comprising the same decontamination agent but no coviscosant.

The efficacy of the decontamination agent used is in no way affected by the presence of a coviscosant in the gel of the invention.

For example, the corrosive properties of the so-called "acid oxidizing gels" of the invention described below are absolutely not deteriorated through the addition of a coviscosant.

Moreover, these gels maintain their characteristic structure much longer and are therefore much easier to remove, for example by rinsing, hence a further decrease in the volume of rinsing effluent.

Finally, the price of the reagents used, which are easily available, is low and the gels of the invention may therefore be used on a large scale and on an industrial level.

The gel of the invention is obtained by adding, to an aqueous solution, constituent a) that is to say a viscosing/gelling agent which comprises the combination of a mineral viscosing agent and an organic viscosing agent.

The mineral viscosing agent is generally a mineral viscosing agent which is insensitive to oxidation, resists against active decontamination constituents b) and preferably has a high specific surface area, for example of over 100 m2/g.

The incorporation into viscosing agent a) of an organic viscosing agent of the invention makes it possible, through a synergetic effect between both viscosing agents (mineral viscosant and coviscosant) to reduce in spectacular manner the amount of mineral viscosing agent that is required to ensure the formation of a gel having sufficient viscosity so that it can remain as a layer on the surface of the part, which may not necessarily be horizontal, and which may even be vertical or inclined.

Generally, it is preferred that the gel should have a viscosity of $10^{-3}$ to $10^{-1}$ Pa.sec, preferably $10^{-2}$ Pa.sec at the time of use, that is to say under strong shear forces, so that it may be applied easily to the surface of a part, for example by spraying with a gun.

According to the invention, and unlike the gels of the prior art whose viscosing agent comprises solely a mineral viscosing agent, the content of this mineral viscosing agent may generally be lowered, for example down to less than 20% by weight, for example from 1 to 15% by weight, preferably from 1 to 8% by weight, further preferably from 1 to 7% by weight, for example from 4 to 6% by weight, in particular 5% by weight.

In respect of alumina, the content of the mineral viscosing agent may be lowered for example down to 1 to 15% by weight, preferably from 1 to 8% by weight, further preferably from 1 to 7% by weight, for example from 4 to 6% by weight, in particular 5% by weight of the solution.

In respect of silica, the content of the mineral viscosing agent may, for example, represent less than 8%, for example from 1 to 7% and generally from 4 to 6%, for example 5% by weight of the solution.

This content value is only given for guidance purposes and is especially related to the mineral viscosing agent and active decontamination agent used.

For a similar gel, the mineral content of the gel of the invention is always greatly reduced in relation to the equivalent gel which only comprises a mineral viscosing agent.

The mineral viscosing/gelling agent may be $Al_2O_3$ alumina based, and it may be obtained by high temperature hydrolysis. As an example of mineral viscosing/gelling agent which may be used, mention may be made of the product sold under the trade name "Alumine C ".

The mineral viscosing/gelling agent may also be silica-based; this silica may be hydrophilic, hydrophobic, basic such as the silica marketed under the name "Tixosil 73 " by RHONE-POULENC, or it may be acid such as the silicas marketed under the names "TIXOSIL 331 " and "TIXOSIL 38AB" marketed by RHONE-POULENC.

Among the acid silicas, mention may be made of the silicas in liquid form marketed under the names "SNOWTEX O" and "SNOWTEX OL" by NISSAN CHEMICAL INDUSTRIES, and the silicas marketed under the general name "Cab-O-Sil" by DEGUSSA such as the silicas "Cab-O-Sil" M5, "Cab-O-Sil" H5 and "Cab-O-Sil" EH5.

Among these silicas, the pyrogenous silica "Cab-O-Sil" M5 which is hydrophilic and acid, with a specific surface area of 200 $m^2/g$, is preferred and gives best results: that is to say maximum viscosing properties for minimal mineral content, in particular when used in so-called "oxidizing gels".

According to one essential characteristic of the invention, viscosing agent a) comprises, in addition to the mineral viscosing agent described above, an organic viscosing agent.

This organic viscosing agent, also called "coviscosant" is generally chosen from among hydrosoluble polymers and surfactants.

Preferably this polymer or this surfactant agent must meet a certain number of conditions related, in particular, to its use in nuclear installations.

It must not comprise either sulphur or halogen, it must make a minimum contribution to overall organic load, have good resistance in the presence of active decontamination agents a): for example a good resistance in an acid and/or oxidizing medium. It must also be little sensitive to the ionic strength of the medium, have thermal stability in the general range of temperature of 0 to 50° C. Finally, it must have good affinity with the mineral viscosing agent, in particular with silica.

Among the preferred hydrosoluble organic polymers, mention may be made of the polymers of acrylic acid and its copolymers with the acrylamide.

These polymers may be used in the gel to a very low percentage content, for example from 0.1 to 5%, preferably 0.1 to 2% by weight, further preferably from 0.5 to 1% by weight, a content level at which they bring about a significant improvement in the Theological properties of the gels and a sizeable decrease in the mineral content of alumina and/or silica, which may for example be reduced from 15 to 5% by weight.

The surfactants included in viscosing agent a) of the invention must generally meet the conditions already described above.

According to the invention, it was surprisingly brought to light that the surfactants of the polyoxyethylene ether family having the formula:

$$CH_3—(CH_2)_{n-1}—(O—CH_2—CH_2)_m—OH$$

also called $C_nE_m$, meet the required criteria, that is to say that among other things they show a high affinity with mineral particles, in particular silica particles, strong chemical inertia and sufficient stability in particular in highly acid, highly oxidizing media that are electrolytically powerful such as decontamination gels.

Even in very small quantities, these surfactants are able to ensure the three-dimensional network construction of a thixotropic gel.

Without referring to any theory, it would seem that there may be simultaneous involvement of interactions between silica particles and polar head, and interactions between hydrophobic aliphatic chains.

In the above formula, n defines the length of the aliphatic chain and is a whole number which may vary from 6 to 18, preferably from 6 to 12, m determines polar head size and is a whole number which may vary from 1 to 23, preferably from 2 to 6.

Among the surfactants, compounds $C_6E_2$ (di(ethylene glycol) hexyl ether), $C_{10}E_3$ and $C_{12}E_4$ are preferred.

Such $C_nE_m$ compounds are available from ALDRICH AND SEPPIC.

The type of surfactant is related to the type of decontamination gel used, that is to say to the nature and content of active decontamination agent a) and to the nature and content of the mineral viscosing agent.

Therefore, compounds $C_nE_m$ are particularly adapted for use in acid oxidizing gels comprising silica.

In the same way, the surfactant content depends upon the nature of the decontamination gel and upon the concentration and nature of the mineral viscosing agent.

This surfactant content generally lies between 0.1 and 5% by weight, preferably between 0.2 and 2% by weight, and further preferably between 0.5 and 1% by weight.

Viscosing agent a) of the invention may be used in any decontamination gel regardless of type, that is to say whatever active decontamination agent b) is used in the decontamination gel.

It may, in particular, be used instead of the exclusively mineral viscosing agent used in any of the decontamination gels of the prior art, such as described for example in documents FR-A-2 380 624 , FR-A-2 656 949 and FR-A 2 695 839.

It has been seen that decontamination gels are of different types depending upon the active decontamination agent b) which they contain; a distinction is generally made between so-called alkaline gels, acid gels, reducing gels and oxidizing gels.

Consequently, the decontamination gel of the invention may, as active decontamination agent b), contain an acid, preferably a mineral acid chosen from among hydrochloric acid, nitric acid, sulphuric acid, hosphoric acid and their mixtures.

The concentration of the acid present is generally between 1 to 10 mol/l, preferably between 3 and 10 mol/l.

Said so-called "acid gel" is specially adapted for the removal of cold-fixed contamination on ferrite steels.

In this type of acid gel, the mineral viscosing agent is preferably silica and the coviscosant is preferably a polyoxyethylene ether.

The decontamination gel of the invention may also contain a base as active decontamination agent (b), preferably a mineral base preferably chosen from among soda, potash and their mixtures.

The base is generally present in a concentration of 0.1 to 14 mol/l.

This type of gel called an "alkaline gel" has advantageous degreasing properties and is particularly suitable for the removal of non-fixed contamination on stainless and ferrite steels.

In this type of alkaline gel, the mineral viscosing agent is preferably alumina.

The decontamination gel of the invention may also contain a reducing agent as active decontamination agent b), such reducing agent may for example be a reducing agent such as that described in document FR-A-2 695 839 in which the reducing agent used is a reducing agent having a standard electrode potential $E_o$ that is less than −600 mV/SHE (standard hydrogen electrode) in a strong base medium (pH=13).

By way of example of such reducing agents, mention may be made of borohydrides, sulphites, sulphides, hydrosulphites or hypophosphites, these generally being in the form of metal salts, for example salts of alkali metals such as sodium.

When sodium borohydride is used as a reducing agent, the pH of the colloid solution is preferably 14 or higher for the borohydride to remain stable.

As described in document FR-A-2 695 839, reducing agents are generally associated with a mineral base such as NaOH or KOH at a concentration that generally lies between 0.1 and 14 mol/l, the concentration of reducing agent being generally between 0.1 and 4.5 mol/l.

In said reducing gel the mineral viscosing agent is rather alumina based.

Said gel called a "reducing gel" is used in general in addition to and alternately with an oxidizing gel such as described below.

With this type of gel it is possible to weaken and move the superficial adherent layers of metal oxide which were heat deposited on the surface of alloys such as austenite stainless steels, Inconel and Incoloy which form the primary circuits of pressurized water reactors and are insensitive to the action of oxidizing decontaminant gels.

The decontamination gel of the invention may also, as active decontaminaton agent b), contain an oxidizing agent.

This oxidizing agent may, for example, be an oxidizing agent such as that described in document FR-A-2 659 943 in which the oxidizing agent used is an oxidizing agent which must have a standard electrode potential of more than 1400 mV/SHE in a strong acid medium (pH<1), that is to say an oxidizing strength that is higher than that of permanganate.

As an example of such oxidizing agents, mention may be made of $Ce^{IV}$, $Co^{III}$, and $Ag^{II}$ and their mixtures.

The potentials of the oxido-reducing couples which correspond to these oxidizing agents have the following values:

$Ce^{III}/Ce^{IV}$ Eo/SHE=1610 mV $Co^{II/CoIII}$ Eo/SHE=1820 mV $Ag^{I}/Ag^{III}$ Eo/SHE=1920 mV

The use of these powerful oxidizing agents is particularly suitable when the surface to be decontaminated is a metal surface, for example in a noble alloy, such as 304 and 316L stainless steels, Inconel and Incolloy.

In addition, these oxidizing agents may also oxidize certain colloidal oxides that are little soluble, such as $PuO_2$, converting them into a soluble form such as $PuO_2^{2+}$.

In the decontaminant gel of the invention, the oxidizing agent may also be used in its reduced form, for example $Ce^{III}$, $Co^{III}$, $Ag^{I}$ may be used, provided that a compound is added to the gel which is able to oxidize this reduced form, or provided that the gel is associated with another gel or with another colloidal solution containing a compound able to oxidize this reduced form of the oxidizing agent.

The compound able to oxidize the reduced form of the oxidizing agent may for example, be made up of a persulphate of an alkali metal.

The oxidizing agents, of which Cerium (IV) is preferred, are generally associated with a mineral base or, for stabilization purposes, with a mineral acid such as HCl, $H_3PO_4$, $H_2SO_4$ and preferably $HNO_3$ at a concentration which generally lies between 1 and 10 mol/l, preferably between 3 and 10 mol/l, further preferably between 2 and 3 mol/l; for example 2.88 mol/l, the concentration of oxidizing agent generally lying between 0.1 and 2 mol/l, preferably between 0.6 and 1.5 mol/l, said concentration being further preferably 1 mol/l.

When an oxidizing cation is used as oxidizing agent such as $Ce^{IV}$, $Ag^{II}$ or $Co^{III}$, the latter may be added in the form of one of its salts such as nitrate, sulphate or other, but it may also be electrogenerated.

The preferred oxidizing gels contain cerium (IV) in the electrogenerated form cerium (IV) nitrate $Ce(NO_3)_4$, or hexanitrato cerate of diammonium $(NH_4)_2Ce\ (NO_3)_6$, the latter being preferred given the relative instability of cerium (IV) nitrate in a concentrated nitric medium.

Nitric acid stabilizes cerium to oxidation degree IV, contributes towards corrosion and ensures, among other things, the maintaining in solution of corroded species, namely oxo-nitrato complexes of transition metals which make up the metal alloy.

Said gels contain for example the mineral viscosing agent, preferably silica such as "Cab-O-Sil" M5, at a concentration of preferably between 4 and 6% by weight, for example 5% by weight, and the organic viscosing agent, preferably polyoxyethylene ether of type $C_6E_2$, $C_{10}E_3$ or $C_{12}E_4$ for example, at a concentration lying preferably between 0.2 and 2% by weight, for example 1% by weight.

Therefore a typical oxidizing decontaminant gel of the invention is made up of a colloid solution comprising:

- 0.6 to 1.5 mol/l, preferably 1 mol/l of $(NH_4)_2\ Ce(NO_3)_6$ or $Ce(NO_3)_4$,
- 2 to 3 mol/l, preferably 2.88 mol/l of $HNO_3$,
- 4 to 6% by weight, preferably 5% by weight of silica,
- 0.2 to 2% by weight, preferably 1% by weight of a polyoxyethylene ether.

The above-described decontaminant gels may be used in particular for the decontamination of metal surfaces, both for periodic maintenance of existing installations and for the dismantling of nuclear installations.

The gels of the invention may be used for example to decontaminate tanks, fuel storage pools, glove boxes etc.

Therefore a further purpose of the invention is a decontamination process for metal surfaces which comprises the application of a decontaminant gel of the invention to the surface to be decontaminated, maintaining this gel on the surface for sufficient time for decontamination to take place, this period ranging for example from 10 min to 24 h, preferably from 30 min to 10 h, further preferably from 2 to 5 hours, removing this gel from the treated metal surface for example by rinsing or mechanical action.

The quantities of gel deposited on the surface to be decontaminated are generally 100 to 2000 g/m$^2$, preferably between 100 and 1000 g/m$^2$, further preferably between 200 and 800 g/m$^2$.

Needless to say, the treatment may be repeated several times using the same gel or gels of different types during the various successive stages, each of these stages comprising the application of a gel, maintaining the gel on the surface and removing the gel from the surface, for example by rinsing or mechanical action.

Also, the treatment may be repeated over the entire surface to be treated or over only part of the latter which may, for example, be of complex shape, or require intensive treatment on account of the surface activity (mRad/h) at certain particular points.

It is also possible, in particular before the first application of the gel, to carry out one or more rinsing operations of the surfaces to be decontaminated using water or an aqueous solution, preferably under high pressure, in order to clean and/or degrease the surface to be treated.

For example, the decontamination process may comprise the following successive stages such as described in document FR-A-2 695 839:

1) applying to the surface to be decontaminated a reducing decontaminant gel of the invention, maintaining this gel on the surface for a period ranging from 10 min to 5 h and rinsing the metal surface to remove the reducing gel, and 2) applying to the surface treated in this way, an oxidizing gel in an acid medium, maintaining this gel on the surface for a period ranging from 30 min to 5 h and rinsing the metal surface thus treated to remove the oxidizing gel.

Or else the decontamination process may comprise the following stages:

spraying onto the surface to be decontaminated a soda solution for a period of 30 minutes for example, rinsing with water applying onto the surface thus treated an oxidizing gel in an acid medium and maintaining it on the surface for a period of 30 minutes to 5 hours, preferably for two hours, rinsing with water.

The contact time may vary between wide limits and also depends upon the type of active decontamination agent and the type of "coviscosant" agent used. For example, for an acid oxidizing gel comprising a surfactant as coviscosant, contact time is preferably between 30 min and 5 hours, further preferably between 2 and 5 hours.

For a reducing gel, contact time is preferably between 10 minutes and 5 hours.

The application of the gel to the metal surface to be decontaminated may be conducted using usual methods, for example by gun spraying, by soaking and draining, by wrapping or even using a brush. Preferably the gel is applied by spraying with a gun, for example under an injector pressure (Airless compressor) of between 10 and 200 kg/cm$^2$, for example of between 10 and 160 kg/cm$^2$, as a further example of between 50 and 100 kg/cm$^2$.

The gel may be removed from the treated surface, preferably by rinsing, or using other means of removal such as mechanical means or by blasting of gas, for example of compressed air.

For rinsing, usually demineralised water is used or an aqueous solution in which the gel used may be dissolved or in which a removable film may be formed which can be flushed away with the water.

Rinsing may be conducted under pressure, that is to say at a pressure of 10 to 160 kg/cm$^2$ for example.

According to one particularly advantageous characteristic of the invention, since the gels of the invention, which comprise the combination of a mineral viscosing agent such as silica, with an organic viscosing agent such as a surfactant, preserve their gel consistency for long periods which may reach 48 hours and more, rinsing of the surface is much easier, can be carried out at low pressure, for example 15 kg/cm$^2$, or even without pressure, and requires smaller quantities of demineralized or other water, for example less than 10 liters/m$^2$.

The number of rinsing treatments (or passes) which are required during a decontamination process to reach the laid-down mineral contents of effluent (for example those set for $SiO_2$ and $A1_2O_3$ levels in fuel storage waters during decontamination) is reduced since the gel of the invention has a lower mineral content.

Here again, through the invention, the quantity of effluent generated, as determined in particular by the volume of rinsing effluent, is greatly reduced.

On the contrary, gels without an organic coviscosant, for example with no surfactant, of the prior art solely comprising silica for example, become dry and cracked after application in a relatively short time, their rinsing is very difficult and requires a large quantity of water under high pressure. On this account, substantial quantities of liquid effluent are generated.

Rinsing effluent is then treated in adequate manner, for example it can be neutralized, by soda for example if an acid gel was used.

The effluent generally undergoes subsequent solid-liquid separation, for example by filtering with a cartridge filter to yield both liquid effluent and solid waste whose quantity is extremely reduced owing to the low mineral content of the gels of the invention.

Consequently, since the mineral content of the gels of the invention is reduced for example by a factor of 3 to 4 compared with the gels of the prior art, which solely comprise a mineral viscosing agent, the solid waste held back by the filters for example is also reduced by a similar factor, for example 3 to 4.

In some cases, the quantity of mineral load in the gel of the invention is even so small that the rinsing effluent can be conveyed towards an evaporator with no prior treatment.

The decontaminant gels of the invention may be prepared in simple manner, for example by adding viscosing agent a) to an aqueous solution of constituent b), that is to say of the active decontamination agent. Generally, the mineral viscosing agent, such as silica, is added before the organic viscosing agent (coviscosant).

The gels of the invention generally have a very long storage life, however the chemical inertia of some surfactants although good is nevertheless limited in time, for example in the presence of an oxidant such as Ce (IV).

The high solubility of these surfactants induces swift homogenization during their incorporation into the gel. They should therefore preferably be added to the solution just before the gels are used in order to achieve optimal efficiency.

BRIEF DESCRIPTION OF DRAWINGS

Other characteristics and advantages of the invention will be better understood on reading the following examples which, needless to say, are non-restrictive being given for guidance purposes and refer to the appended drawings in which.

Also shown is the curve giving the viscosity in relation to re-setting time of a gel comprising solely 10% of "Cab-O-Sil" as viscosing agent (lower continuous curve).

EXAMPLE 1

The rheological properties were examined of aqueous gels representing the prior art by measuring their viscosity at different times, time 0 corresponding to the moment when the gel is sprayed.

Figure 1:
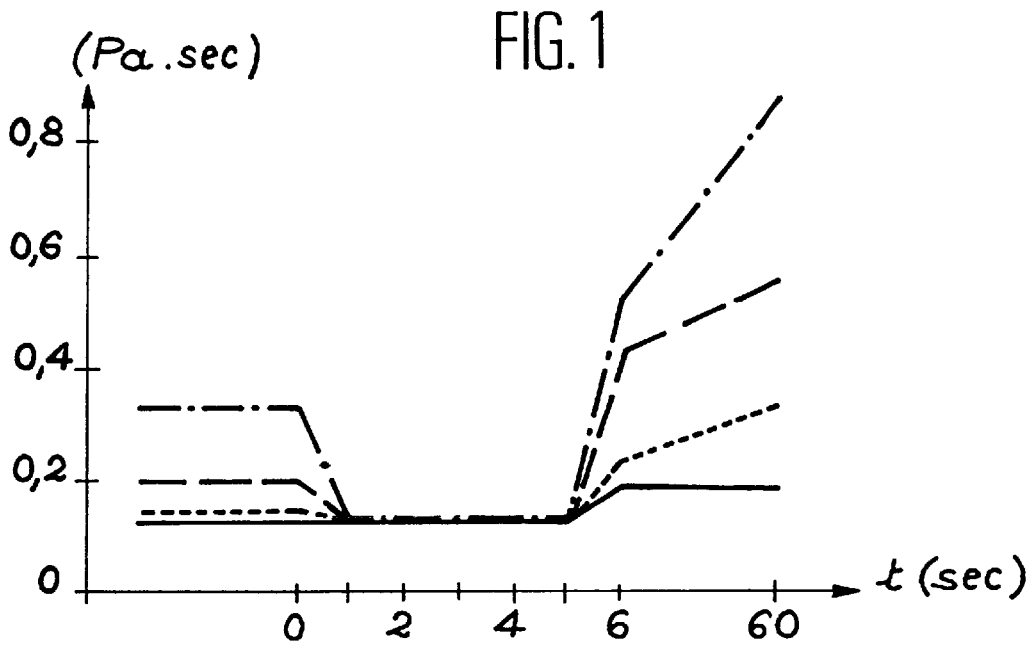
FIG. 1 illustrates the viscosity (expressed as Pa.sec) in relation to re-setting time (in sec) of various gels representing the prior art, whose viscosing agent solely comprises "Cab-O-Sil" M5 in respective contents by weight of 6% (continuous line), 8% (dotted line), 10% (dashed line) and finally 12% (chain dotted line).

The results are given in FIG. 1 which shows the curves giving the viscosity in relation to re-setting time of gels whose viscosing agent solely comprises a mineral viscosing agent: namely "Cab-O-Sil" M5 silica, at respective content levels of 6%, 8%, 10% and 12%.

It will be noticed that regardless of the "Cab-O-Sil" M5 content of these gels, the re-gelling times always exceeds 5 seconds and are therefore too long, even with high concentrations of silica.

EXAMPLE 2

The rheological properties of gels of the invention were examined by measuring their viscosity at different times, time 0 corresponding to the moment when the gel is sprayed.

Figure 2:
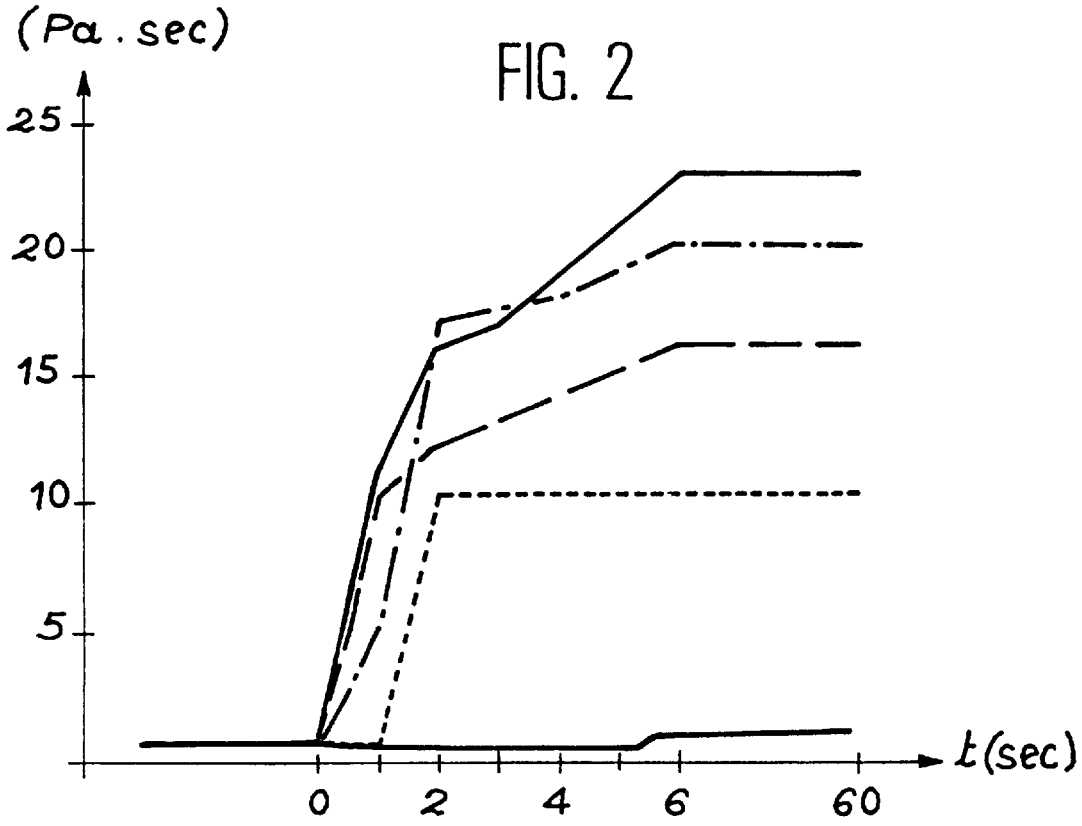
FIG. 2 illustrates the viscosity (expressed as Pa.sec) in relation to re-setting time (in sec) of various gels whose viscosing agent in conformity with the invention comprises respectively the combination of "Cab-O-Sil" at 6% by weight with Texipol (1%) (dotted line), of "Cab-O-Sil" at 5% by weight with $C_{12}E_4$ (1%) (dashed line), of "Cab-O-Sil" at 5% by weight with $C_{10}E_3$ (1%) (chain dotted line), of "Cab-O-Sil" at 5% by weight with $C_6E_2$ (1%) (upper continuous line).

The results are given in FIG. 2 which shows the curves giving the viscosity in relation to re-setting time of the gels whose viscosing agent, in accordance with the present invention, comprises the combination of a mineral viscosing agent ("Cab-O-Sil" silica) with a surfactant ("$C_6E_2$", "$C_{10}E_3$" or "$C_{12}E_4$") or a polymer ("Texipol") each time at 1% by weight.

For comparative purposes, FIG. 2 also shows the curve already shown in FIG. 1 giving the viscosity in relation to re-setting time of a gel solely comprising 10% "Cab-O-Sil" as a viscosing agent.

The curves in FIG. 2 show the spectacular development of the rheological properties of different gels prepared in accordance with the invention. The low viscosity under high shear forces (t=0) of the gels of the invention remains lower than the gels of the prior art shown in FIG. 1 and lower than 0.1 Pa.sec.

The gels prepared with the combinations of viscosing agents of the invention are therefore, when shaken, and like the gels of the prior art, sufficiently liquid to be sprayed.

But, in addition, all the gels prepared with the combinations of viscosing agents of the invention have an increased ability to restructure themselves in spectacular, surprising and fully unexpected proportions.

The viscosity at rest of all the gels prepared in accordance with the invention, having a combination of a viscosing agent of silica type with a "coviscosant" agent of surfactant or polymer type, is considerably increased even with very low concentrations (1%) of polymer or surfactant.

Therefore, the viscosity at rest of a gel of the invention such as the gel prepared with a viscosing agent comprising 5% by weight of "Cab-O-Sil" and 1% by weight of surfactant $C_6E_2$, is multiplied up to fifty-fold to reach 20 to 25 Pa.s.

The curves in FIG. 2 also show that the re-setting time of the gels of the invention are extremely reduced and that the restructuring of the gels of the invention is virtually instantaneous ensuring almost immediate adhesion to the treated surface.

The improvement in the rheological properties of the gels of the invention due to the incorporation into the gel of a specific organic viscosing agent (coviscosant) in addition to the mineral viscosing agent goes hand in hand with a substantial decrease in concentration of the mineral viscosing agent. The gels of the invention incorporating quantities of silica as low as 5% by weight offer greatly improved rheological properties compared with the gels of the prior art incorporating the same quantity of silica but with no organic coviscosant.

It can be therefore be talked in terms of an authentic synergy effect between the mineral viscosing agent and the coviscosant.

If it is desired to prepare gels in accordance with the invention having similar properties to those of gels of the prior art with no coviscosant, the concentration of mineral viscosing agent such as silica could in fact be lowered to less than 1%, even less than 0.1% by weight.

The gels of the invention therefore generate a smaller quantity of waste on account of their much lower mineral content.

EXAMPLE 3

This example relates to the use of oxidizing gels of the invention which comprise an oxidizing agent, Cerium (IV), as active decontamination agent and polyethylene ethers or a hydrosoluble polymer as organic viscosing agent (coviscosant) Corrosion tests were conducted under inactive conditions, that is to say in the absence of radioactive contamination, on metal plates of stainless austenite steel of 316L type; this stainless steel contained iron (70%), chromium (17%), nickel (11%) and molybdenum (2%).

The gels tested were prepared by adding to demineralized water for the preparation of one kg of gel:

- 370 g hexanitrato cerate of diammonium:$(NH_4)_2Ce(NO_3)_6$ obtained from ALDRICH), i.e. a concentration of 1 mol/l.
- 105 ml 65% nitric acid obtained from ALDRICH, i.e. a $HNO_3$ concentration of 2.88 mol/l.
- 50 g or 60 g of "Cab-O-Sil" M5 obtained from DEGUSSA, i.e. a silica concentration of 5% or 6% by weight according to gel type.
- 10 g of TEXIPOL 63–510 obtained from SCOTT BADER, i.e. a concentration of 1% by weight, or else, according to gel type, 10 g of polyoxyethylene ether of $C_6E_2$ type hexyl ether of glycol diethylene obtained from ALDRICH, or $C_{10}E_3$ obtained from SEPPIC, or $C_{12}E_4$ (called "BRIJ 30 ") obtained from ALDRICH. The concentration of surfactant was therefore 1% by weight.

The prepared gels were applied to the steel plates to be treated to a thickness of 1 mm, i.e. I kg of gel per $m^2$ of surface to be treated.

The corrosion effect was checked and weighed.

The quantity of cerium used in this example, i.e. 1 mol/liter was able to remove from the steel plate an average of 1 micron in one hour with a gel thickness of approximately 1 mm.

Table I below specifies the quantities of matter removed from a new stainless steel plate of 316L type using different gels with a cerium (IV) concentration of 1M.

TABLE I

| Coviscosant | Mineral content (by weight) | Age | Quantity of gel (kg/m$^2$) | Time | Corrosion (?m) |
|---|---|---|---|---|---|
| $C_6E_2$ 1% | 5% Cab-O-Sil | 1 day | 1.12 | 2 h | 1.2 |
| $C_6E_2$ 1% | 5% Cab-O-Sil | 1 day | 1.26 | 2 h | 1.2 |
| $C_6E_2$ 1% | 5% Cab-O-Sil | 1 day | 1.40 | 2 h | 1.6 |
| $C_{10}E_3$ 1% | 5% Cab-O-Sil without Ce | 1 day | 0.99 | 1 h | 0 |
| $C_{10}E_3$ 1% | 5% Cab-O-Sil | 20 min | 1.04 | 1 h | 1.1 |
| $C_{10}E_3$ 1% | 5% Cab-O-Sil | 1 day | 0.7 | 2 h | 0.9 |
| $C_{10}E_3$ 1% | 5% Cab-O-Sil | 5 days | 1.53 | 2 h | 0.3 |
| $C_{12}E_4$ 1% | 5% Cab-O-Sil | 2 days | 1.62 | 1 h | 1.3 |
| $C_{12}E_4$ 1% | 5% Cab-O-Sil | 2 days | 1.21 | 2 h | 1.5 |
| $C_{12}E_4$ 1% | 5% Cab-O-Sil | 2 days | 1.24 | 7 h | 1.5 |
| Texipol 1% | 6% Cab-O-Sil | 26 days | 0.7 | 30 min | 0.8 |
| Texipol 1% | 6% Cab-O-Sil | 26 days | 0.97 | 2 h | 1 |
| Texipol 1% | 6% Cab-O-Sil | 26 days | 1.55 | 1 h | 1.3 |
| Texipol 1% | 6% Cab-O-Sil | 26 days | 0.74 | 2 h | 0.9 |

The quantity of corroded alloy was essentially related to the quantity of cerium (IV) in the gel, it is therefore entirely normal that all these values are comparable.

These results show that the presence of a surfactant or polymer in the oxidizing gel of the invention in no way hampers the diffusion of dissolved species in these gelled media.

EXAMPLE 4

Corrosion tests were conducted under the same conditions as in Example 3 on metal plates of 316L type. The tested gels had the following formula $(NH_4)_2$ $Ce(NO_3)_6$IM, $HNO_3$ 2, 88M, $SiO_2$ "Cab-O-Sil" M5 5% by weight, Polyoxyethylene ethers of $C_6E_2$, $C_{10}E_3$ or $C_{12}E_4$ type at 1% by weight.

For comparison, a weakly viscous oxidizing gel comprising as active agent hexanitrato cerate of diammonium 1M and 2.88M nitric acid, and as viscosing agent 8% by weight "Cab-O-Sil" M5, with no coviscosant, underwent parallel testing.

It is to be pointed out that the poor rheological properties of this gel of the prior art meant that it could not be sprayed.

The thickness of the gel applied was approximately 1 mm, i.e. 1 kg of gel per m$^2$ of surface to be treated. The corrosive effect was checked by weighing.

Table II below specifies the quantities of matter removed from a commercially available plate in stainless steel of 316L type that was naturally rendered passive.

TABLE II

| Sample | Coviscosant | Mineral content Cab-O-Sil (% by weight) | Quantity of gel (kg/m2) | Time h | Corrosion (?m) |
|---|---|---|---|---|---|
| 1 | without surfactant | 8 | 1.10 | 1 | 0.4 |
| 2 | without surfactant | 8 | 1.12 | 2 | 1 |
| 3 | without surfactant | 8 | 1.14 | 5 | 1.4 |
| 4 | without surfactant | 8 | 1.13 | 24 | 1.5 |
| 5 | $C_6E_2$ 1% | 5 | 1.11 | 1 | 0.4 |
| 6 | $C_6E_2$ 1% | 5 | 1.10 | 2 | 0.9 |
| 7 | $C_6E_2$ 1% | 5 | 1.13 | 5 | 1.2 |
| 8 | $C_6E_2$ 1% | 5 | 1.11 | 24 | 1.2 |
| 9 | $C_{10}E_3$ 1% | 5 | 1.20 | 1 | 0.4 |
| 10 | $C_{10}E_3$ 1% | 5 | 1.12 | 2 | 0.8 |
| 11 | $C_{10}E_3$ 1% | 5 | 1.1 | 5 | 1.2 |
| 12 | $C_{10}E_3$ 1% | 5 | 1.10 | 24 | 1.2 |
| 13 | $C_{12}E_4$ 1% | 5 | 1.10 | 1 | 0.4 |
| 14 | $C_{12}E_4$ 1% | 5 | 1.10 | 2 | 0.8 |
| 15 | $C_{12}E_4$ 1% | 5 | 1.10 | 5 | 1.3 |
| 16 | $C_{12}E_4$ 1% | 5 | 1.11 | 24 | 1.3 |

The corrosion data given in Table II show that for 1.1 kg of gel per m$^2$, whatever type of gel is used, generalized erosion is virtually identical and on average :

0.4 $\mu$m in I hour 0.9 $\mu$m in 2 hours 1.2 $\mu$m in 5 and 24 hours

The following remarks may be made on gel status after a contact time of 5 and 24 hours:

Sample 4, Without Surfactant

After a contact time of 5 and similarly 24 hours, the "gel" has maintained its orange color, characteristic of the presence of Ce(IV) species. After 24 hours, it is completely dry and cracked, rinsing of the plate is difficult: its surface is of "marbled" appearance.

Sample 8, $C_6E_2$ 1%

After a contact time of 5 hours, the gel has lost all coloring, apart from a slight blue tinge, no doubt due to the presence of oxides or oxonitrato complexes of transition metals.

After 24 hours, and despite a loss in weight of 25%, it maintains its gel consistency, and plate cleaning is much easier than with the gel with no surfactant and requires less then 10 liters water/m$^2$ at low pressure.

Sample 12, $C_{10}E_3$ 1% and Sample 16, $C_{12}E_4$ 1%

After 24 hours the gels show some residual yellow color, they are not cracked despite a loss in weight of 27%. They maintain their gel consistency and their rinsing is easy.

It arises from all these results that:

in the gel without a surfactant, a contact time of 24 hours does not allow total Ce(IV) consumption even if corrosion values are high. Also rinsing problems occur.

at 5 hours, the loss of orange color of the gel with a surfactant indicates "total" reduction of Ce(IV) to Ce(III).

Stoppage of corrosion after this application time is confirmed, moreover, by the generalised corrosion values. It therefore appears needless to extend contact time beyond 5 hours.

Also, gels with surfactants are all easy to rinse with smaller quantities of water, namely less than 10 liters/$m^2$ at low pressure.

the difference in color after 5 hours corrosion time between gels with (colourless) and without (orange) surfactant for identical corrosion indicates that part of the Ce(IV) oxidizes the surfactant. This is an advantage to restrict the chemical oxygen requirements of effluent by degradation of the surfactant. This particular point will be further developed below.

Remark

A second corrosion on sample n°5 with the same quantity of gel showed a corrosion of 0.9 $\mu$m, whereas 0.4 $\mu$m had been removed in one hour during the first application. Therefore, once the passive layer due to natural oxidation has been removed, generalized erosion is in the region of 1 $\mu$m in one hour, in conformity with Example 3 above.

Four successive attacks on this same plate subsequently showed a corrosion of: 0.9–1–1.1 and 0.9 $\mu$m. The same results are obtained whichever type of gel is used, whether with or without surfactant.

EXAMPLE 5

This example relates to the use of oxidizing gels of the invention comprising "Cab-O-Sil" silica at 5 or 6% by weight as mineral viscosing agent; $C_6E_2$ at 0.7 or 1% by weight as organic viscosing agent (coviscosant), and as oxidizing agent 1 mol/l hexa nitrato cerate of diammonium and 2.88 mol/l $HNO_3$.

The application conditions of the gels were the same as for examples 3 and 4 above, but the corrosion tests were conducted on oxidized plates of 316L type.

Samples were prepared by heating plates similar to those used in examples 3 and 4 in an oven at 600° C. under a flow of air, following the method described by W. N. Rankin in "Decontamination processes for waste glass canisters. Nuclear Technology, vol. 59, 1982".

This heat treatment generates a layer of oxide on the surface of non-oxidizing alloys, and its composition, thickness and morphology are comparable with that which may be found on the surface of steels to be decontaminated.

Table III below specifies the quantities of matter removed with different gels from non-oxidizing steel plates of 316L type. The plates had been oxidized for 4 days by heating at 600° C. (the oxide layer was uniform).

TABLE III

| Sample | Coviscosant | Mineral content Cab-O-Sil (% by weight) | Quantity of gel (kg/$m_2$) | Time h | Corrosion (?m) |
|---|---|---|---|---|---|
| 20 | without surfactant | 8 | 1.11 | 2 | 1.6 |
| 21 | without surfactant | 8 | 1.11 | 5 | 2.2 |
| 22 | without surfactant | 8 | 1.11 | 24 | 2.6 |
| 23 | $C_6E_2$ 1% | 5 | 1.07 | 2 | 0.6 |

TABLE III-continued

| Sample | Coviscosant | Mineral content Cab-O-Sil (% by weight) | Quantity of gel (kg/$m_2$) | Time h | Corrosion (?m) |
|---|---|---|---|---|---|
| 24 | $C_6E_2$ 1% | 5 | 1.09 | 5 | 1.4 |
| 25 | $C_6E_2$ 1% | 5 | 1.11 | 24 | 2.3 |

Table IV below specifies the quantities of matter removed from stainless steel 316L plates. The plates had been oxidized for 2 days by heating at 600° C., the oxidide layer was not uniform on the plate surface:

TABLE IV

| Sample | Coviscosant | Mineral content Cab-O-Sil (% by weight) | h Quantity of gel (kg/$m^2$) | Time h | Corrosion (?m) |
|---|---|---|---|---|---|
| 26 | $C_6E_2$ 1% | 5 | 1.08 | 1 | 1.1 |
| 27 | $C_6E_2$ 1% | 5 | 1.08 | 2 | 1.6 |
| 28 | $C_6E_2$ 0.7% | 6 | 1.09 | 1 | 0.6 |
| 29 | $C_6E_2$ 0.7% | 6 | 1.10 | 2 | 1.6 |
| 30 | $C_6E_2$ 0.7% | 6 | 1.11 | 5 | 2.0 |

Examples 3 to 5 above show that, in addition to the unexpected improvement in Theological properties and the decrease in mineral content obtained by using a coviscosing agent in an oxidizing gel of the invention, the presence of surfactant limits only very moderately the corrosive capacity of the gels, since only a small part of Ce(IV) is consumed by the surfactant.

During corrosion, unlike the gel without surfactant, gel structure is maintained guaranteeing improved diffusion of species whether corrosive or corroded. Also, rinsing is made easier.

Furthermore, corrosion by gel only slightly alters the condition and composition of the plate surfaces.

the following examples give examples of application of the gels of the invention and of existing gels.

EXAMPLE 6

In this example, decontamination is carried out using the process of the invention to decontaminate a 50 $m^3$ tank in 316L stainless steel, that is to say having a surface of 120 $m^2$ to be decontaminated.

An acid oxidizing gel of the invention is used having the following composition:

| | |
|---|---|
| "Cab-O-Sil" M5: | 5% |
| Coviscosant (polyethylene ether "$C_6E_2$") | 1% |
| CeIV: | 0.5M |
| $HNO_3$: | 10M |

The decontamination treatment comprises the following stages:

spraying a soda solution onto the tank surface and maintaining it on the surface for 2 hours rinsing with water gun spraying the acid oxidizing gel of the invention described above at a pressure of 15 kg/$cm^2$ in such manner as to deposit 1 kg per $m^2$ of surface, and maintaining this gel on the surface for 12 hours rinsing with water at low pressure, namely 15 kg/$cm^2$, spraying a second pass of gel under the same conditions as above, i.e. 1 kg per $m^2$ of surface with an application time of 2 hours, rising with water at low pressure, i.e. approximately 15 kg/$cm^2$ Before and after treatment the dose rate of the surface was determined.

The initial dose rate of the surface was 557 mRad/h and its final dose rate was 4 mRad/h.

The decontamination factor FD was also determined which corresponds to the ratio of initial dose rate over final dose rate and was approximately 140.

EXAMPLE 7 (COMPARATIVE)

The decontamination of a tank in stainless steel identical to that in Example 6 was examined, but this time using a commercially available oxidizing gel of "FEVDIRAD OX" type that can be obtained from FEVDI and has the following composition:

| | |
|---|---|
| "Cab-O-Sil" M5: | 15% |
| CeIV: | 0.5M |
| $HNO_3$: | 10M |

The stages and treatment conditions for decontamination were the same as for example 6, except that during the rinsing stages to remove the gel it was required to use very high pressure of 150 to 300 kg/$cm^2$ instead of a low pressure.

A decontamination factor of 140 was obtained.

However, in addition to the fact that the removal of the gel by rinsing was much more difficult than in the preceding example and required much higher pressure, and that the volume of rinsing effluent was much greater; during subsequent filtering of the rinsing effluent, the lower mineral content reduced by a factor of 3 of the organomineral gel of the invention, used in the preceding example, produced a quantity of solid waste that was three times smaller than that generated by the filtration of rinsing effluent from the gel of the present example which represents the prior art.

EXAMPLE 8

In this example, the process of the invention was used to decontaminate three glove boxes in 316L stainless steel contaminated essentially by the radioelements Uranium, Caesium, Plutonium and Strontium.

These glove boxes had an overall surface to be decontaminated of 26 $m^2$.

An acid oxidizing gel of the invention was used having the same composition as the gel in Example 6, namely:

| | |
|---|---|
| "Cab-O-Sil" M5: | 5% |
| Coviscosant (polyethylene ether "$C_6E_2$ ") | 1% |
| CeIV: | 0.5M |
| $HNO_3$: | 10M |

The decontamination treatment comprised the following stages:

spraying a soda solution for 15 minutes rinsing with water gun spraying, at a pressure of 15 kg/$cm^2$, an acid oxidizing gel of the invention as described above so as to deposit a total of 80 kg of oxidizing gel, and maintaining this gel on the surface for 2 hours, rinsing with water at low pressure measuring the dose rate of the surface, spraying a second pass of oxidizing gel, i.e. a total of 10 kg, solely onto some particular areas depending upon the dose rate previously measured. The gel was maintained on these surface parts for two hours.

rinsing with water at low pressure.

Before and after treatment the dose rate of the surface was measured.

The initial dose rate of the surface was 3 Rad/h and the final dose rate was between 2 and 20 mRad/h.

The decontamination factor was approximately 150.

EXAMPLE 9 (COMPARATIVE)

Glove boxes identical to those in Example 8 were decontaminated with a commercially available oxidizing gel of "FEVDIRAD OX" type obtainable from FEVDI, having the following composition:

| | |
|---|---|
| "Cab-O-Sil" M5 | 15% |
| CeIV: | 0.5M |
| $HNO_3$: | 10M |

The decontamination treatment stages and conditions were the same as in Example 8, except that during rinsing to remove the gel a very high pressure was required (150 to 300 kg/$cm^2$) instead of low pressure.

A decontamination factor of 150 was obtained.

However, in addition to the fact that the removal of the gel by rinsing was much more difficult than in the preceding example, requiring much higher pressure, and that the volume of rinsing effluent was much greater; during subsequent filtering of the rinsing effluent, the lower mineral content reduced by a factor of 3 of the organomineral gel of the invention used in the previous example, produced a quantity of solid waste that was three times smaller than that generated by filtration of the rinsing effluent from the gel of the present example which represents the prior art.

What is claimed is:

1. An organomineral decontamination gel, comprising a colloid solution comprising:

a) a viscosing agent; and b) an active decontamination agent;

wherein the viscosing agent a) comprises a combination of a mineral viscosing agent with an organic viscosing agent (coviscosant) selected from the group consisting of polyoxyethylene ethers having the formula:

$CH_3—(CH_2)_{n-1}—(O—CH_2—CH_2)_m—OH$, wherein n is a whole number of from 6 to 18 and m is a whole number of from 1 to 23.

2. The gel of claim 1, wherein the mineral viscosing agent is selected from the group consisting of silicas and aluminas.

3. The gel of claim 2, wherein the mineral viscosing agent used is a silica in an amount of 1 to 7% by weight.

4. The gel of claim 2, wherein the mineral viscosing agent used is an alumina in an amount of 1 to 15% by weight.

5. The gel of claim 1, wherein the coviscosant is present in an amount of 0.1 to 5% by weight.

6. The gel of claim 1, which is an "acid gel", wherein the active decontamination agent b) comprises a mineral acid.

7. The gel of claim 6, wherein the mineral acid is hydrochloric acid, nitric acid, sulphuric acid, phosphoric acid, or a mixture thereof.

8. The gel of claim 6, wherein the mineral acid is present at a concentration of 1 to 10 mol/l.

9. The gel of claim 1, wherein the active decontamination agent b) comprises a mineral base.

10. The gel of claim 9, wherein the mineral base is selected from the group consisting of soda, potash and mixtures thereof.

11. The gel of claim 9, wherein the mineral base is present in a concentration of 0.1 to 14 mol/l.

12. The gel of claim 1, which is a "reducing gel", wherein the active decontamination agent b) comprises a reducing agent.

13. The gel of claim 12, wherein the reducing agent has a standard electrode potential $E_O$ of less than −600 mV/SHE (standard hydrogen electrode) in a basic medium having a pH of 13.

14. The gel of claim 13, wherein the reducing agent is selected from the group consisting of borohydrides, sulphites, hydrosulphites, sulphides, hypophosphites, zinc, hydrazine, and mixtures thereof.

15. The gel of claim 13, wherein the active agent b) also comprises a mineral base at a concentration of 0.1 to 14 mol/l.

16. The gel of claim 12, wherein the reducing agent is present at a concentration of 0.1 to 4.5 mol/l.

17. The gel of claim which is called an "oxidizing gel", wherein the active decontamination agent b) comprises an oxidizing agent or the reduced form thereof.

18. The gel of claim 17, wherein the oxidizing agent is present in a concentration of 0.1 to 2 mol/l.

19. The gel of claim 17, wherein the oxidizing agent has a standard electrode potential $E_O$ of more than 1400 mV/SHE (standard hydrogen electrode) in an acidic medium having a pH if less than 1.

20. The gel of claim 19, wherein the oxidizing agent is selected from the group consisting of $Ce^{IV}$, $Ag^{II}$, $Co^{III}$ and mixtures thereof.

21. The gel of claim 20, wherein the $Ce^{IV}$ is in the form of cerium nitrate, cerium sulphate or hexanitrato cerate of diammonium.

22. The gel of claim 19, wherein the oxidizing gel, in addition to the reduced form of the oxidizing agent, also comprises a compound which oxidizes a reduced form thereof.

23. The gel of claim 22, wherein the compound which oxidizes reduced form of the oxidizing agent is a persulphate of an alkali metal.

24. The gel of claim 19, wherein the active agent b), in addition to the oxidizing agent, also comprises a mineral acid or a mineral base at a concentration of 1 to 10 mol/l.

25. The gel of claim 24, wherein the mineral acid is selected from the group consisting of $HNO_3$, HCl, $H_3PO_4$, $H_2SO_4$ and mixtures thereof.

26. An oxidizing decontamination gel, which comprises a colloid solution, comprising:

a) 0.6 to 1 mol/l of $(NH_4)_2$ $Ce(NO_3)_6$ or of Ce $(NO_3)_4$, b) 2 to 3 mol/l of $HNO_3$, c) 4 to 6% by weight of silica, and d) 0.2 to 2% by weight of a polyoxyethylene ether.

27. The oxidizing decontamination gel of claim 26, wherein said $(NH_4)_2$ $Ce(NO_3)_6$ or $Ce(NO_3)_4$ is present in an amount of 1 mol/l.

28. The oxidizing decontamination gel of claim 26, wherein said $HNO_3$ is present in an amount of 2.88 mol/l.

29. The oxidizing decontamination gel of claim 26, wherein said silica is present in an amount of 5% by weight.

30. The oxidizing decontamination gel of claim 26, wherein said polyoxyethylene ether is present in an amount of 1% by weight.

31. A process for decontaminating a metal surface, which comprises:

a) applying onto a surface to be decontaminated the gel of claim 1, b) maintaining the gel on the surface for a time sufficient to effect decontamination, and c) removing the gel from the metal surface.

32. The process of claim 31, wherein the gel is applied by gun spraying.

33. The process of claims 31, wherein the gel is maintained on the surface for a period of 10 minutes to 24 hours.

34. The process of claim 31, wherein the gel is an acid oxidizing gel and is applied to a surface for a time of between 2 and 5 hours.

35. The process of claim 31, wherein the gel is removed from the surface by rinsing.

36. The process of claim 31, wherein the gel is applied to the surface to a thickness of 100 g to 2000 $g/m^2$.

* * * * *